US012735225B1

(12) United States Patent
Blakely et al.

(10) Patent No.: US 12,735,225 B1
(45) Date of Patent: Sep. 15, 2026

(54) TOTE TANK ACCESSORY KIT

(71) Applicant: CAMCO MANUFACTURING, LLC, Greensboro, NC (US)

(72) Inventors: Brandon Blakely, Burlington, NC (US); Gregory Walton, Kernersville, NC (US); Niko Jovicevic, Statesville, NC (US); Bruce Andrew Angel, Stokesdale, NC (US)

(73) Assignee: Camco Manufacturing, LLC, Greensboro, NC (US)

( * ) Notice: Subject to any disclaimer, the term of this patent is extended or adjusted under 35 U.S.C. 154(b) by 11 days.

(21) Appl. No.: 19/087,252

(22) Filed: Mar. 21, 2025

Related U.S. Application Data

(63) Continuation-in-part of application No. 29/993,334, filed on Mar. 13, 2025, and a continuation-in-part of application No. 29/993,337, filed on Mar. 13, 2025.

(51) Int. Cl.

| | |
|---|---|
| ***B65D 21/02*** | (2006.01) |
| ***B65D 25/28*** | (2006.01) |
| ***B65D 43/16*** | (2006.01) |
| ***B65D 43/22*** | (2006.01) |

(52) U.S. Cl.
CPC ..... *B65D 21/0228* (2013.01); *B65D 25/2808* (2013.01); *B65D 43/163* (2013.01); *B65D 43/22* (2013.01)

(58) Field of Classification Search
CPC ..... B65D 21/0228; B65D 25/2808; B65D 43/163; B65D 43/22; B65D 21/0235
USPC ..... 206/372, 477, 512, 503, 464; 220/699, 220/737; 137/259
See application file for complete search history.

(56) References Cited

U.S. PATENT DOCUMENTS

| | | | | |
|---|---|---|---|---|
| 8,353,417 | B1 * | 1/2013 | Wu | B65D 45/20 220/23.6 |
| D868,209 | S | 11/2019 | Atwell et al. | |
| 2015/0001119 | A1 * | 1/2015 | Wang | B65D 88/022 269/236 |
| 2018/0273245 | A1 * | 9/2018 | Sommer | B65D 21/0212 |
| 2023/0132547 | A1 * | 5/2023 | Niemela | B60R 3/02 280/727 |
| 2023/0202025 | A1 * | 6/2023 | Chen | B25H 3/04 206/503 |
| 2023/0278191 | A1 * | 9/2023 | Zhang | B65D 21/0228 206/503 |
| 2024/0190612 | A1 * | 6/2024 | Christopher | F16B 2/18 |

(Continued)

*Primary Examiner* — Rafael A Ortiz
(74) *Attorney, Agent, or Firm* — Tuggle Duggins PA; Blake P. Hurt

(57) ABSTRACT

A storage case system designed for attachment to portable blackwater tanks, facilitating the transportation and storage of blackwater accessories. The system comprises a base with a textured floor bordered by an interior and exterior wall, featuring an access gap for accessible utility. The inclusion of a mounting channel and screw mount allows for secure attachment via an elongated mounting member, which connects to the tank and the case. A matching lid with corresponding walls and access gap ensures that items are securely stored while allowing for access. Additional features include a handle for improved portability, a rubber strap and strap cover for secure closure, and the option for dual elongated mounting members for enhanced stability of the case.

20 Claims, 8 Drawing Sheets

(56) References Cited

U.S. PATENT DOCUMENTS

2024/0351743 A1* 10/2024 Li ..... B65D 21/0223
2025/0346194 A1* 11/2025 Lambert ..... B60R 9/06

* cited by examiner

TOTE TANK ACCESSORY KIT

REFERENCE TO RELATED APPLICATIONS

The present application is a continuation-in-part of and claims priority to U.S. Design patent application Ser. No. 29/993,334, filed Mar. 13, 2025 and titled "TOTE TANK ACCESSORY KIT," and is a continuation-in-part of and claims priority to U.S. Design patent application Ser. No. 29/993,337, filed Mar. 13, 2025 and titled "TOTE TANK ACCESSORY KIT," which are incorporated herein by reference in their entireties.

TECHNICAL FIELD

The present disclosure relates generally to storage and transport of wastewater disposal equipment and accessories. In particular, some aspects of the disclosure may relate to systems for storing wastewater disposal accessories in a modular case removably attached to a wastewater tank.

DESCRIPTION OF RELATED ART

Managing wastewater efficiently and hygienically can be a significant challenge for recreational vehicle (RV) enthusiasts, particularly when it comes to disposing of black water, which contains human waste. RVs typically hold three primary types of water: fresh, grey, and black. Fresh water is stored for drinking and cooking, grey water collects from sinks and showers and contains soap particles and food residue, and black water, the most challenging to manage, comes from the toilet. Traditional methods of disposing of this waste involve the use of specialized hoses that connect the vehicle's blackwater holding tank to a designated dump station. These hoses are crucial for maintaining hygiene and environmental standards, allowing for the safe and efficient transfer of waste materials to proper disposal facilities.

Conventionally, after use, these hoses must be cleaned, dried, and stored until their next use. A common practice has been to store these hoses underneath the RV in dedicated compartments or externally attached storage bins. This method of storage, while space-efficient, poses several issues. First, retrieving and repacking the hoses can be cumbersome, often requiring the user to stoop or kneel on the ground, which may not always be clean. Moreover, the hoses, even when cleaned, can retain residual waste material odors, which can permeate the storage area and, by proximity, the living areas of the RV.

Transporting these hoses separately to a dump site further complicates the disposal process. The physical handling of the hoses increases the risk of contaminating the user's clothing or skin, and if hoses are not thoroughly cleaned and dried before storage, it can lead to the growth of bacteria and mold. Additionally, the repeated coiling and uncoiling of hoses for storage and use contribute to wear and tear, leading to leaks and failures that can cause unsanitary conditions and environmental hazards.

These conventional methods reveal a clear need for an improved solution that addresses the inefficiencies, potential health risks, and general unpleasantness associated with the storage and transportation of blackwater hoses and accessories.

BRIEF SUMMARY OF THE DISCLOSURE

Embodiments of the present disclosure address the issues present in traditional systems by introducing a modular storage case configured for the efficient, hygienic storage and transportation of blackwater hoses and accessories. This innovative system, easily attachable to portable blackwater tanks, provides a convenient, secure, and sanitary method for managing these components. By incorporating features such as a textured floor with an access gap, a secure mounting mechanism, and a dual-function lid that aligns with the base for comprehensive enclosure, certain embodiments may significantly reduce the risk of contamination and wear associated with traditional hose storage methods. Furthermore, the system's ease of attachment and detachment from the blackwater tank facilitates a more streamlined and less contact-intensive process for transporting hoses to and from dump sites, directly addressing the conventional challenges of manual handling, cleanliness, and odor containment.

Embodiments of the present disclosure may include a modular case for transportation and storage of blackwater accessories. The modular case may include a repeatably closeable case including a base and lid. The base may include a mounting channel covered by a screw mount. Additionally, an elongated mounting member may be positioned on a blackwater tank and be configured to attached to the blackwater tank via a screw on a first end and received via a frame in the mounting channel on a second end. The elongated mounting member may extend perpendicularly away from the screw a distance corresponding to an internal mounting channel distance.

Further embodiments of the present disclosure may include the base, the lid, and the elongated mounting member being constructed from molded plastic. The base and the lid each may include an opening through their respective middle regions such that when the case is disposed on the blackwater tank, a user can access a flushing connection on the blackwater tank through the middle region of the modular case without physically touching the modular case. The blackwater tank may further include a screw on a handle of the blackwater tank to secure the elongated mounting member to a top portion of a handle of the blackwater tank and further to allow the base to slide onto the elongated mounting member and be secured with the screw. The modular case may further include a rubber strap, attached to the lid, and configured to be pulled over a hook included on the base to secure the modular case in a closed position, and a strap cover, configured to snap onto the lid to hold the rubber strap in place, further including a second screw installed through an underside of the lid into the strap cover. Additionally, the distance the elongated mounting member extends perpendicularly away from the screw may be equivalent to the internal mounting channel distance.

Embodiments of the present disclosure may include a modular storage case releasably attachable to a portable blackwater tank. The modular storage case may include a base, a lid, and an elongated mounting member. The base may include a textured floor comprising a first outer edge and a first inner edge, wherein the first inner edge may define an access gap through a middle region of the textured floor; a lower interior wall connected to the textured floor along the first inner edge; and a lower exterior wall connected to the textured floor along the first outer edge; wherein the lower exterior wall may further include a mounting channel and a screw mount, the screw mount extending perpendicularly away from the exterior wall and including a screw hole. The lid may include a ceiling including a second outer edge and a second inner edge, wherein the second inner edge may define a matching access gap through a middle region of the ceiling; an upper interior wall connected to the ceiling along the second inner edge adjacent to an upper perimeter of the matching access gap, and wherein the upper interior wall aligns with the lower interior wall, when the modular storage case is in a closed position; and an upper exterior wall connected to the ceiling along the second outer edge. The elongated mounting member may include a frame with a first end and a second end; the first end including a tapped hole, wherein the tapped hole may be configured to align with the screw hole and a corresponding hole in the portable blackwater tank; and the second end comprising an angled point. The mounting channel of the base of the modular storage tank may be configured to receive the elongated mounting member.

Further embodiments of the present disclosure may include the base, the lid, and the elongated mounting member being constructed from molded plastic. The modular storage case may further include a handle. The handle may include a lower half connected to the lower interior wall and an upper half connected to the upper interior wall. The modular storage case may further include a rubber strap, attached to the upper exterior wall of the lid, and configured to be pulled over a hook included on the lower exterior wall of the base to secure the modular case in a close position, and a strap cover, configured to snap onto the upper exterior wall of the lid to hold the rubber strap in place, further including a second screw installed through an underside of the lid and into the strap cover. The modular storage case may be configured to be attached to the portable blackwater tank when in the closed position, such that when the modular storage case is in the closed position, the modular storage case may be slid on to the elongated mounting member via the mounting channel and secured with the screw. The modular storage case may further include a second elongated mounting member disposed on the portable blackwater tank and a second mounting channel disposed on the base. Additionally, the access gap may be a dodecagon.

Embodiments of the present disclosure may include a storage case for sewer hose accessories. The storage case may include a base, a lid, two elongated mounting members, and two mounting channels. The base may include a textured floor, an interior wall and exterior wall each adjacent to the textured floor, and two mounting channels. The lid may include a ceiling, a corresponding interior wall, and a corresponding exterior wall each adjacent to the ceiling. The two elongated mounting members each may include a tapped hole and a frame configured to be received by the two mounting channels.

Further embodiments of the present disclosure may include an access gap spaced through a center region of the textured floor and ceiling. The access gap may be a dodecagon. The storage case may also include two screw mounts, where each screw mount extends perpendicularly away from the exterior wall of the base, and each screw mount further includes a screw hole. Further, the tapped hole of the storage case may be configured to align with the screw hole and a corresponding hole in a blackwater tank. The storage case may further include a handle, the handle may include a lower half connected to the lower interior wall and an upper half connected to the upper interior wall. The storage case may further include a rubber strap, attached to the corresponding exterior wall of the lid and configured to be pulled over a hook included on the exterior wall of the base to secure the storage case in a closed position, and a strap cover, configured to snap onto the corresponding exterior wall of the lid to hold the rubber strap in place, further including a second screw installed through an underside of the lid and into the strap cover.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto and their equivalents thereof.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

Figure 1:
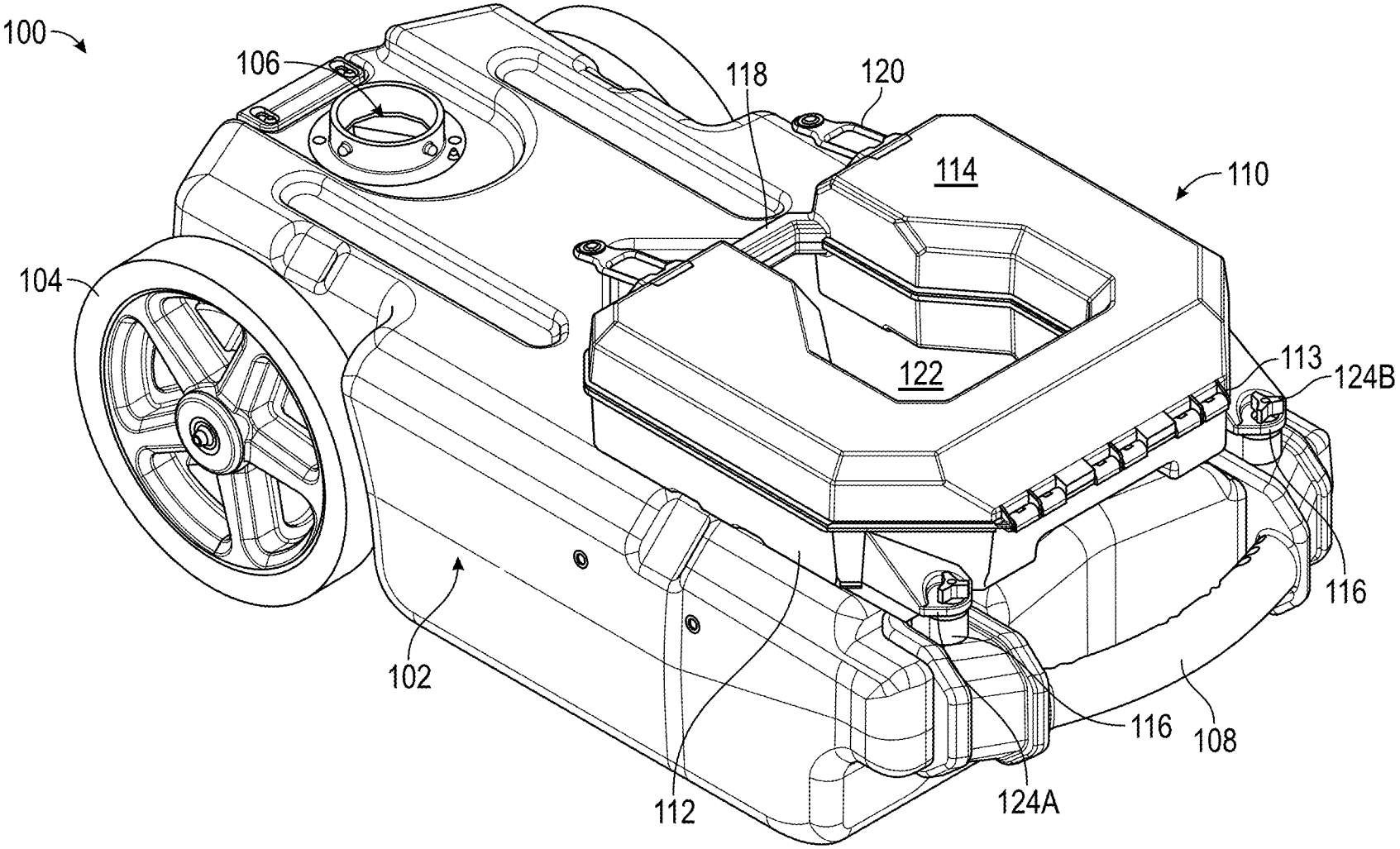
FIG. 1 is a diagram showing a perspective illustration of an example tote tank accessory kit, in accordance with various embodiments of the disclosed technology.

The figures are not exhaustive and do not limit the present disclosure to the precise form disclosed.

DETAILED DESCRIPTION

The present disclosure addresses various challenges associated with the storage and transportation of wastewater management equipment for recreational vehicle (RV) enthusiasts, particularly focusing on the storage of accessories for the disposal of blackwater. Traditional approaches often involve cumbersome and unsanitary methods of storing and transporting sewer hoses and related accessories, leading to potential leaks, environmental contamination, and unpleasant odors. These conventional methods lack a systematic and hygienic way to manage these essential tools, especially when moving them to and from disposal sites. The risk of contamination and damage to the hoses increases without secure and dedicated storage solutions. Moreover, the absence of an integrated and easily accessible storage solution complicates these tasks further, especially under conditions of limited visibility. The disclosed tote tank accessory kit case (also discussed as a modular storage case) system innovatively addresses these problems by providing a secure, hygienic, and convenient way to store, transport, and access wastewater disposal equipment.

In the broader context of hose accessory management for utility and sanitation purposes, achieving a balance of efficiency, hygiene, and convenience remains a significant challenge. This is true not only for RV enthusiasts dealing with blackwater disposal but also across a spectrum of scenarios where managing hoses and similar equipment is necessary. The need for solutions that streamline these processes, reduce the potential for contamination, and enhance user convenience is evident. The modular storage case system introduced in this disclosure represents an improved solution designed to address these challenges. By offering a secure and organized method for storing and transporting hoses and accessories, the system presents a widespread improvement for managing wastewater disposal and fluid transfer equipment, ensuring that efficiency, hygiene, and convenience are at the forefront of the user experience.

Embodiments of the present disclosure discuss a modular case and its application for the transportation and storage of fluid transfer accessories. Embodiments of the present disclosure may be applicable in various environments, including blackwater disposal, gardening and agriculture irrigation, industrial fluid transfer, brewing and distillation operations, oil and gas transfer, chemical manufacturing, pharmaceutical manufacturing and development, food and beverage operations, mining operations and refining, construction, marine operations, automotive manufacturing, aerospace, and textile manufacturing. However, for ease of discussion, exemplary embodiments will be discussed with relation to blackwater disposal.

These embodiments may include a modular case that can be securely closed and reopened multiple times, comprising a base and a lid. The base may include a mounting channel, protected by a screw mount, and an elongated mounting member affixed to a blackwater tank. This elongated mounting member may be designed to attach to the blackwater tank using a screw at one end, while the other end slots into the mounting channel. In various embodiments, the materials the modular case are constructed from may include molded plastics, metals, and advanced composites, for durability and ease of manufacture. In some embodiments, the base and the lid may include central openings or access gaps, allowing users to access the blackwater tank without coming into direct contact with the case, enhancing user convenience and hygiene. Further embodiments may include a screw on the tank's handle, which can facilitate the secure attachment of the elongated mounting member and enable the base to slide onto and secure to the elongated mounting member.

Further embodiments may include a rubber strap attached to the lid, which may fasten over a hook on the base, improving case closure and securement. A strap cover, which may snap onto the lid, can secure the rubber strap, and house a second screw for added securement. The case may be designed for ease of attachment to a blackwater tank, with additional embodiments including a second elongated mounting member and an additional mounting channel on the base for enhanced stability.

The modular storage case may also include a textured floor with defined edges, creating the access gap for easier handling and an integrated handle for improved portability. The access gap may be dodecagonal, offering a distinctive aesthetic and functional advantage, such as easier access or improved grip. The inclusion of two elongated mounting members and corresponding mounting channels in some embodiments may improve mounting and storage options by, e.g., allowing the modular case to support greater amounts of weight. Each embodiment may be directed to secure, durable, and convenient solutions for storing and transporting fluid transfer contents and accessories.

Referring now to the figures, FIG. 1 is a diagram showing a perspective illustration of an example tote tank accessory kit 100, in accordance with various embodiments of the disclosed technology. The tote tank accessory kit 100 may include a tote tank 102 (also referred to as a blackwater tank throughout) with wheels 104 in a first region of the tote tank, an inlet 106 disposed in the same region of the tote tank 102 as the wheels 104, a tote handle 108 disposed in a second region of the tote tank 102, opposite the first region of the tote tank 102 that includes the wheels 104, and a modular storage case 110 disposed thereon. The modular storage case 110 may include a base 112 connected via a hinge 113 to a lid 114, an elongated mounting member 116 attached on a first end to the tote tank's 102 second region and slid thereinto by the case 110 on a second end, a handle 118 constructed into the base 112 and the lid 114, a rubber strap 120 to secure the base 112 and lid 114 together in a closed position, an access gap 122 through a middle region of the modular storage case 110 to allow a user to reach the tote tank 102 without physically contacting the modular storage case 110, and a screw 124A, 124B to secure the modular storage case 110 to the elongated mounting member 116.

Embodiments of the tote tank accessory kit 100 may include a tote tank 102. The tote tank 102 may be an approximately rectangular vessel equipped with distinctive grooves (discussed in relation to FIG. 2) atop its structure to enhance grip, handling, and storage. The tote tank 102 may have a hollow interior, allowing fluid or partially viscous contents to be contained therein for transport or storage. Constructed to facilitate the efficient collection and disposal of blackwater waste, the tote tank 102 may be constructed from durable materials such as molded plastic, metal, and/or advanced composites, offering resilience and longevity under various environmental conditions. Positioned in a first region of the tote tank 102 may be a wheel 104. Some embodiments may include two wheels 104. The wheels 104 may be mounted on opposite sides (widthwise) of the tote tank 102 to improve maneuverability. In some embodiments, there may be a single wheel 104 or more than two wheels 104. For example, for particularly heavy contents there may be two wheels on each side of the tank (i.e., a total of four wheels) for support in, e.g., industrial fluid transfer environments.

The wheels 104 may be complemented by a tote handle 108 located on the opposite end (lengthwise) of the tote tank 102, which may also be considered the tote tank's 102 second region. The tote handle 108 may extend outward/away from the tank starting on a first side of the tank disconnecting from the tank centrally and reconnecting to the tank on a second side (as depicted in FIG. 1). The tote handle 108 may ease the transport of the tote tank 102 by permitting a user to lift one end of the tote tank 102, via the tote handle 108, and pull the tote tank 102 riding on the wheels 104.

The tote tank 102 may further include a disposal inlet 106, which may be configured to accommodate a blackwater hose for both the filling and subsequent emptying of the tank, embodying a more efficient waste transfer solution. The disposal inlet 106 may connect the hollow interior of the tote tank 102 to the outside environment. As such, the disposal inlet 106 may be closeable, such that a cover or valve may prevent waste from exiting the tote tank prior to the designated disposal point. The disposal inlet 106 may also include features to connect the disposal inlet 106 to a blackwater disposal hose. Some embodiments may include smart valves on the disposal inlet 106 so users can open and/or close the disposal inlet 106 via smart technologies. Further embodiments may include a smart sensor on the disposal inlet 106 to measure inflow or outflow of contents.

Additionally, the tote tank may include a flusher connection (discussed in relation to FIG. 3), to facilitate thorough cleaning and maintenance post-disposal, further improving sanitary standard.

Alternative embodiments of the blackwater tote tank 102 may include variations in size and capacity to cater to different usage requirements, ranging from personal RV to commercial and industrial applications. The tank's wall thickness may range from 0.5 centimeters to 10 centimeters for personal RV use but may be thicker for commercial and/or industrial applications. The tank's surface can also incorporate antimicrobial coatings to further enhance hygiene, while smart sensors may be integrated to monitor waste levels and signal when disposal is necessary or complete. For improved durability and environmental adaptability, alternative materials such as recycled plastics or corrosion-resistant alloys may be used for various components, or the entirety of, the tank. Furthermore, the design of the tank can be adapted to include a retractable handle or collapsable sides for compact storage.

Embodiments of the present disclosure may further include a modular storage case 110. The modular storage case 110 may be designed to complement the tote tank 102, improving its utility by providing additional storage capabilities, especially for accessories thereof. The modular storage case 110 may include a base 112 with a textured floor (the internal structure of the case is partially described here and partially described with relation to FIGS. 9, 13, 14-15, which illustrate the internal structure of the case), which may increase grip and stability of contents placed in the case, bordered by a first outer edge and a first inner edge. The first inner edge may delineate an access gap 122. Some embodiments of the access gap 122 may include straight walls with multiple corners, e.g., 12 walls/sides or a dodecagon geometry, through the middle region of the floor, facilitating easy access to the flushing connection or other tank-based features. The base 112 may be further structured internally by a lower interior wall connected along the first inner edge, and externally by a lower exterior wall along the first outer edge. The lower interior and exterior walls may extend perpendicularly away from the textured floor. The exterior wall may include a mounting channel and a screw mount, the latter projecting perpendicularly away from the exterior wall and featuring a screw hole for secure attachment. Some embodiments of the textured floor may be without texture or smooth, while other embodiments may include designs, features, or protrusions specific to the orientation or placement of accessories therein.

The modular storage case 110 may further include a lid 114. The lid 114 may be affixed to the base 112 via a durable hinge 113. The lid 114 may mirror the base's 112 design with a ceiling that hosts a second outer edge and a second inner edge, the latter forming a matching dodecagonal access gap 122. When closed, the lid's 114 upper interior wall may align with the base's 112 lower interior wall. Additionally, an upper exterior wall may extend from the ceiling's second outer edge, completing the enclosure.

Figure 17:
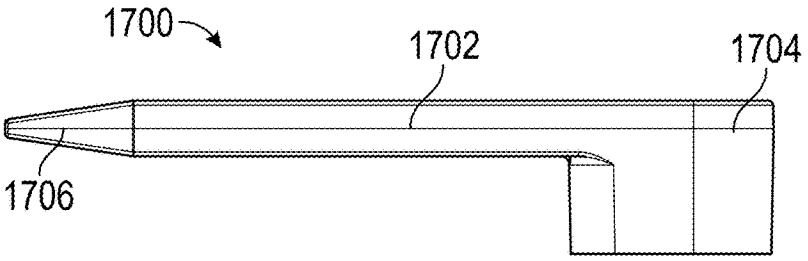
FIG. 17 is a diagram showing a side plan view of an example elongated mounting member, in accordance with various embodiments of the disclosed technology.
Figure 16:
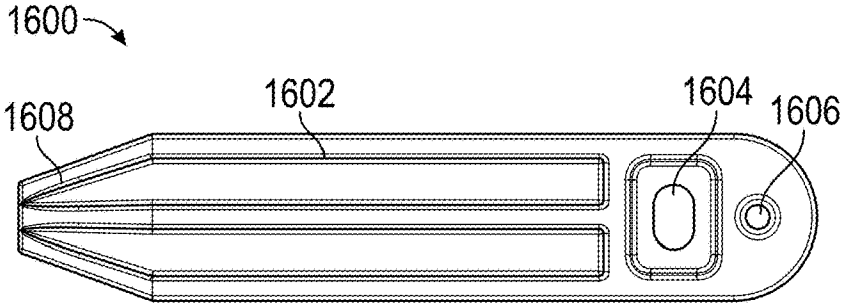
FIG. 16 is a diagram showing a top plan view of an example elongated mounting member, in accordance with various embodiments of the disclosed technology.
Figure 18:
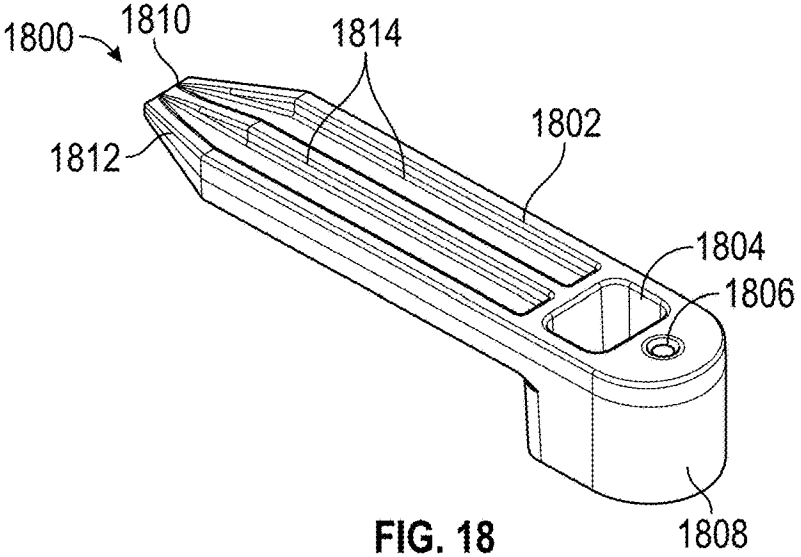
FIG. 18 is a diagram showing a perspective view of an elongated mounting member, in accordance with various embodiments of the disclosed technology.

Attachment to the tote tank 102 may be achieved through an elongated mounting member 116, which may include a tapped hole (the structure of the elongated mounting member 116 is more thoroughly discussed in relation to FIGS. 16-18) at a first end to align with the case's screw mount and a corresponding hole on the tank. A screw 124A, 124B may be placed through the screw mount to securely attach the elongated mounting member 116 to the tote tank 102. The screw 124A, 124B may be a standard tapped screw with thumb mounts to turn the screw, or may be other forms of fasteners, for example, bayonets or bolts. The opposite end (e.g., the second end) of the elongated mounting member 116 may include an angled point designed to engage with the mounting channel for slide-on installation. This connection may be secured by the screw 124A, 124B to attach the modular case 110 to the tote tank 102.

The modular storage case 110 may be constructed from similar materials to those used for the tote tank 102, such as molded plastic, metal, and/or composites. For added convenience, a handle 118 may be integrated into the case. The handle 118 may be the combination of lower and upper halves attached to their respective interior walls. In other words, when the case is in a closed position, the handle 118 may be formed, and when the case is in the open position, two separate partial handles may exist. The handle 118 may be straight, curved, or partially angled, as depicted in FIG. 1.

Embodiments of the modular storage case may also include a rubber strap 120. The rubber strap may secure the modular storage case 110 in a closed position. The rubber strap 120 may be affixed to the upper exterior wall of the lid 114. Designed for durability and flexibility, the rubber strap 120 may be engineered to stretch over and latch onto a hook located on the lower exterior wall of the base 112, such that when secure, the case remains closed during transport or when not in use. To augment the securement feature, a strap cover (not shown) may be constructed to snap onto the upper exterior wall of the lid 114. This cover may hold the rubber strap 120 in place, improving the structural integrity of the securing mechanism. The strap cover also may include a second screw that may be installed through the underside of the lid and into the strap cover itself, providing an additional layer of stability and security.

While rubber may be the descriptive choice for the strap due to its elasticity and durability, alternative materials such as silicone, neoprene, or flexible thermoplastic polyurethane (TPU) can also be used. These materials may also be incorporated into other aspects of the tote tank accessory kit 100. These alternatives may offer various benefits, including enhanced weather resistance, increased flexibility, and the ability to withstand a wider range of temperatures, making them suitable for diverse environments and applications. Silicone straps, for example, may provide a softer, more pliable alternative, whereas neoprene may offer improved chemical resistance, and TPU may offer a balance of flexibility, durability, and resistance to oils and greases. This versatility in material selection may allow the modular storage case 110 to be customized for specifics needs and preferences, ensuring that the securing mechanism, and other features of the case, remains both functional and reliable under different conditions.

Alternative embodiments of the modular storage case 110 may include variations in shape and size to accommodate different storage needs for specific items. The case 110 may also include customizable interior compartments, designs, water-resistant seals for enhanced protection against the elements or environmental hazards, humidity or temperature sensors, and/or smart locking mechanisms for added security. Additionally, some embodiments may integrate thermal insulation materials to protect the internal contents from severe weather that may freeze or otherwise damage the contents of the case.

Figure 2:
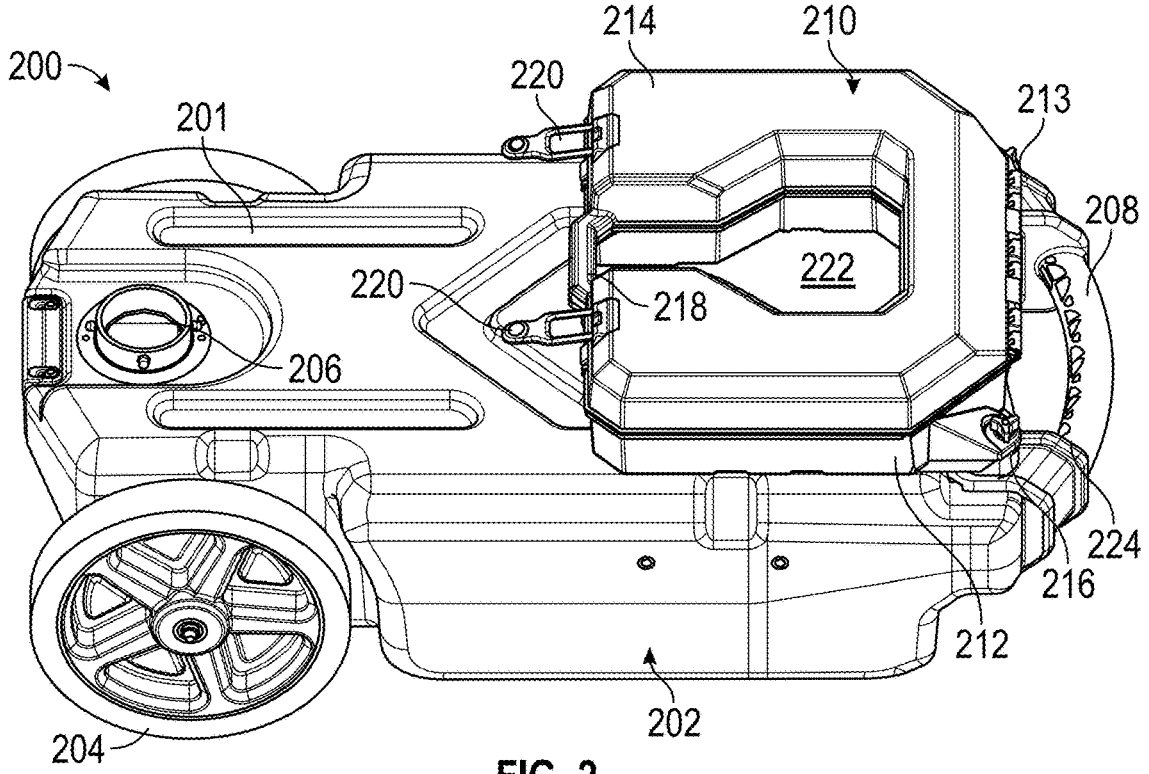
FIG. 2 is a diagram showing a side elevational illustration of an example tote tank accessory kit, in accordance with various embodiments of the disclosed technology.

FIG. 2 is a diagram showing a side elevational illustration of an example tote tank accessory kit 200, in accordance with various embodiments of the disclosed technology. The tote tank accessory kit 200 may similarly include a tote tank 202 with wheels 204 in a first region of the tote tank, an inlet 206 disposed in the same region of the tote tank 202 as the wheels 204, a tote handle 208 disposed in a second region of the tote tank 202, opposite the first region of the tote tank 202 that includes the wheels 204, and modular storage case 210 disposed thereon. The tote handle 208 may be attached to the tote tank 202 via an abutment 224 extending away from the tote tank 202. Some embodiments may include two abutments 224, connecting each end of the tote handle 208 to the tote tank 202. The modular storage case 210 may include a base 212 connected via a hinge 213 to a lid 214, an elongated mounting member 216 attached on a first end to the tote tank 202 and slid thereinto by the case 210 on a second end, a handle 218 constructed into the base 212 and the lid 214, a rubber strap 220 to secure the base 212 and lid 214 together in a closed position, and an access gap 222 through a middle region of the modular storage case 210 to allow a user to reach the tote tank 202 without physically contacting the modular storage case 210.

Notably, some embodiments of the tote tank 202 may include a series of grooves 201 in an upper surface of the tote tank 202. These grooves 201 may extend laterally along the length of the tank or may form other patterns within the upper surface of the tote tank 202. These grooves 201 may allow for tote tanks 202 to be stacked when not in use, by, for example, matching these depressed grooves 201 with corresponding ridges on a bottom surface of the tote tank (not shown). By matching ridges with grooves 201, tote tanks 202 may be stacked such that they do not planarly shift during transport.

Figure 3:
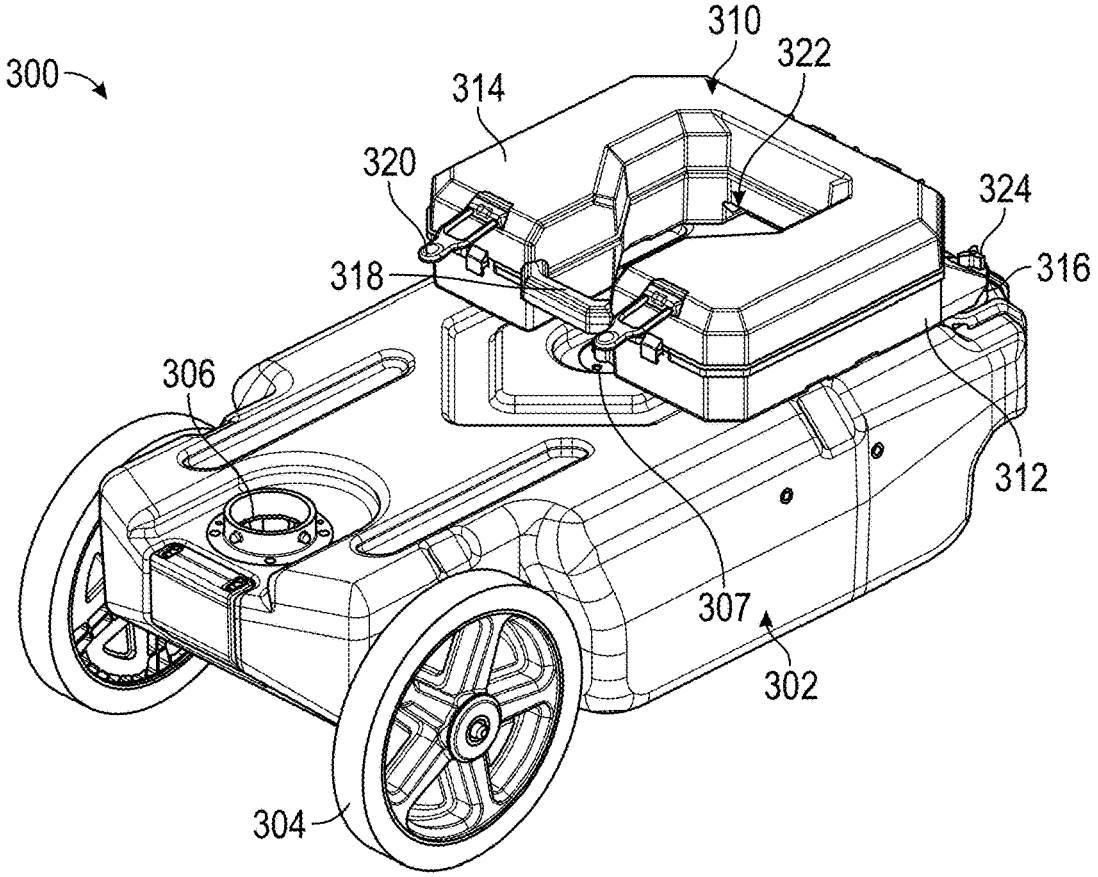
FIG. 3 is a diagram showing a rear perspective illustration of an example tote tank accessory kit, in accordance with various embodiments of the disclosed technology.

FIG. 3 is a diagram showing a rear perspective illustration of an example tote tank accessory kit 300, in accordance with various embodiments of the disclosed technology. The tote tank accessory kit 300 may similarly include a tote tank 302 with wheels 304 in a first region of the tote tank 302, an inlet 306 disposed in the same region of the tote tank 302 as the wheels 304, a flusher connection 307 in a second region of the tote tank 302, opposite the first region of the tote tank 302 that includes the wheels 304, and a modular storage case 310 disposed thereon. The modular storage case 310 may include a base 312 connected to a lid 314, an elongated mounting member 316 attached on a first end to the tote tank 302 and slid thereinto by the case 310 on a second end, a handle 318 constructed into the base 312 and the lid 314, a rubber strap 320 to secure the base 312 and lid 314 together in a closed position, an access gap 322 through a middle region of the modular storage case 310 to allow a user to reach the flusher connection 307 of the tote tank 302 without physically contacting the modular storage case 310, and a screw 324 to secure the modular storage case 310 to the elongated mounting member 316.

Notably, FIG. 3 depicts an example flusher connection 307, which is not shown in FIGS. 1-2. The flusher connection 307 may facilitate the cleaning and maintenance of the tank by allowing a clean water hose to be directly connected to the tote tank 302, at a different point from the inlet 306, for flushing out residues and substances after the disposal of blackwater. This connection may be engineered such that, when a clean water hose is attached, exposure to contaminated or unsanitary substances is reduced, thereby improving the integrity of the flushing process. To maintain further improvement to performance and hygiene, it is important that the flusher connection is kept substantially clean and free from debris. This aids in the effective removal of waste materials from the tank and prevents potential contamination of the clean water hose, encouraging sanitary and efficient cleaning. By placing the modular storage case 310 around the flusher connection 307, the modular storage case 310 can act as a shield to protect the flusher connection from unsanitary fluids that may be discharged during disposal.

Figure 4:
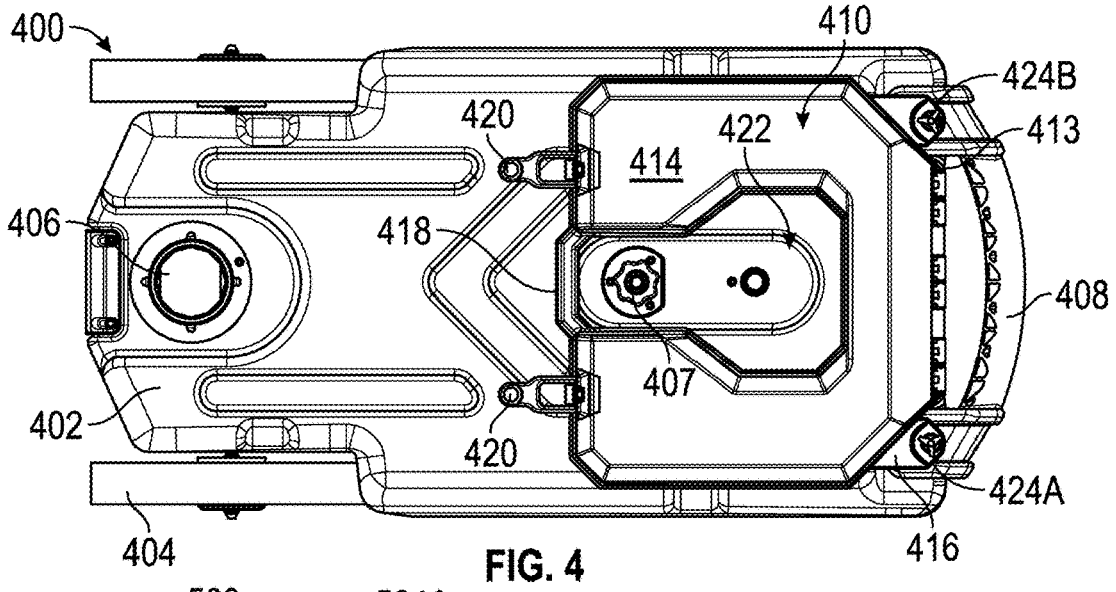
FIG. 4 is a diagram showing a top plan illustration of an example tote tank accessory kit, in accordance with various embodiments of the disclosed technology.

FIG. 4 is a diagram showing a top plan illustration of an example tote tank accessory kit 400, in accordance with various embodiments of the disclosed technology. The tote tank accessory kit 400 may similarly include a tote tank 402 with wheels 404 in a first region of the tote tank 402, an inlet 406 disposed in the same region of the tote tank 402 as the wheels 404, a flusher connection 407 in a second region of the tote tank 402, opposite the first region of the tote tank 402 that includes the wheels 404, a tote handle 408 on the second end of the tote tank 402, and a modular storage case 410 disposed thereon. The modular storage case 410 may include a base 412 connected via a hinge 413 to a lid 414, an elongated mounting member 416 attached on a first end to the tote tank 402 and slid thereinto by the case 410 on a second end, a handle 418 constructed into the base 412 and the lid 414, a rubber strap 420 to secure the base 412 and lid 414 together in a closed position, an access gap 422 through a middle region of the modular storage case 410 to allow a user to reach the flusher connection 407 of the tote tank 402 without physically contacting the modular storage case 410, and a screw 424A, 424B to secure the modular storage case 410 to the elongated mounting member 416.

Figure 5:
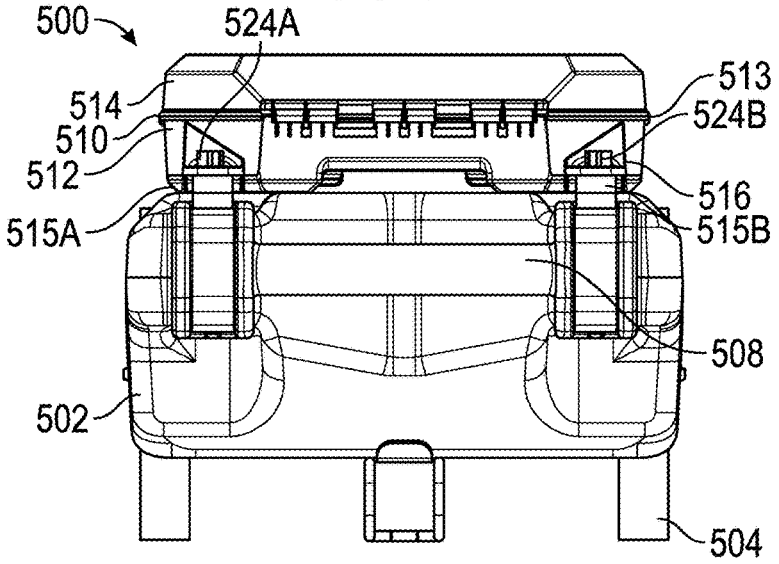
FIG. 5 is a diagram showing a front plan illustration of an example tote tank accessory kit, in accordance with various embodiments of the disclosed technology.

FIG. 5 is a diagram showing a front plan illustration of an example tote tank accessory kit 500, in accordance with various embodiments of the disclosed technology. The tote tank accessory kit 500 may similarly include a tote tank 502 with wheels 504 in a first region of the tote tank 502, a tote handle 508 in a second region of the tote tank 502, and a modular storage case 510 disposed thereon. The modular storage case 510 may include a base 512 connected via a hinge 513 to a lid 514, an elongated mounting member 515A, 515B attached on a first end to the tote tank 502 and slid thereinto via a mounting channel 516 on the case 510 on a second end, and a screw 424A, 424B to secure the modular storage case 410 to the elongated mounting member 416.

Importantly, the front plan illustration, as depicted in FIG. 5, illustrates the layering used to affix the modular storage case 510 to the tote tank 502. For example, the elongated mounting members 515A, 515B may be attached to the tote tank 502 with screws, fasteners, and/or bayonets. The modular storage case 510 may then be slid onto the non-attached end of the elongated mounting members 515A, 515B, such that the non-attached ends slide into the mounting channel 516 of the base 512 of the modular storage case 510. The screw mount may then cover a remaining portion of the elongated mounting member, which can then be secured into place with a screw 524A, 524B.

Figure 6:
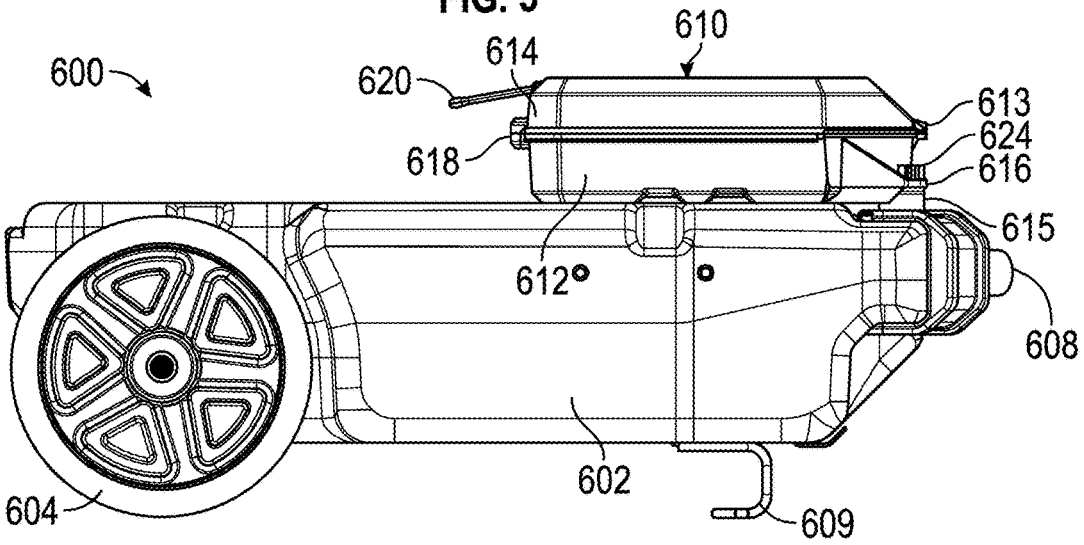
FIG. 6 is a diagram showing a side plan illustration of an example tote tank accessory kit, in accordance with various embodiments of the disclosed technology.

FIG. 6 is a diagram showing a side plan illustration of an example tote tank accessory kit 600, in accordance with various embodiments of the disclosed technology. The tote tank accessory kit 600 may similarly include a tote tank 602 with wheels 604 in a first region of the tote tank 602, a tote handle 608 in a second region of the tote tank 602, a sled 609 on an underside of the tote tank 602, and modular storage case 610 disposed thereon. The modular storage case 610 may include a base 612 connected via a hinge 613 to a lid 614, an elongated mounting member 616 attached on a first end to the tote tank 602 and slid thereinto by the case 610 on a second end, a handle 618 constructed into the base 612 and the lid 614, a rubber strap 620 to secure the base 612 and lid 614 together in a closed position, and a screw 624 to secure the modular storage case 610 to the elongated mounting member 616.

Notably, the sled 609 may provide for a level base for the tote tank. The sled 609 may be approximately the same height as the radius of the wheel minus the radial distance from the wheel's center to the bottom edge of the tote tank 602. In other words, the sled 609 may maintain the tote tank 602 at a level grade so its contents do not unnecessarily shift when placed. The sled 609 may be constructed from molded plastic, metal, polymers, and/or composites and may extend away from the tote tank 602. The sled 609 may curve or may extend straight down towards a ground surface beneath the tote tank 602.

Figure 7:
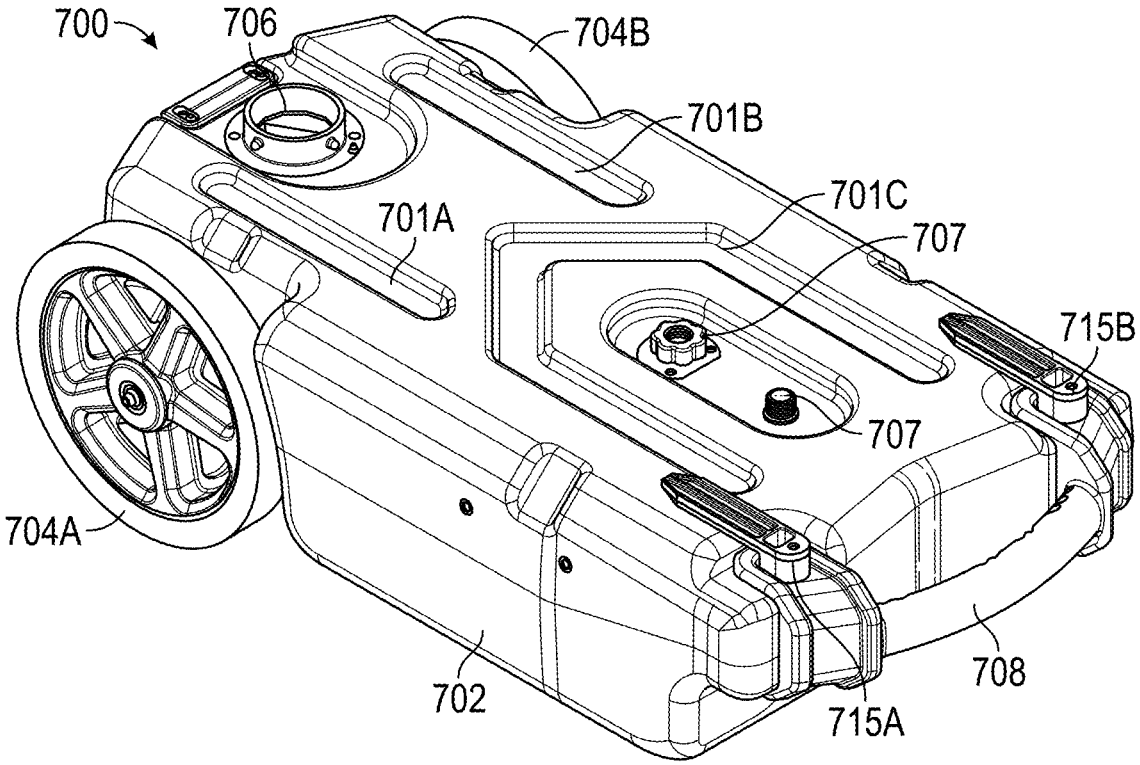
FIG. 7 is a diagram showing a perspective illustration of an example blackwater tote tank, in accordance with various embodiments of the disclosed technology.

FIG. 7 is a diagram showing a perspective illustration of an example blackwater tote tank 700, in accordance with various embodiments of the disclosed technology. The tote tank 700 may include a body 702 with grooves 701A, 701B, 701C thereon. As discussed, the grooves 701A, 701B, 701C may be of varying designs and orientations, and may improve grip on the tank as well as improve stack-ability of multiple tanks. The tote tank 700 may further include one or more wheels 704A, 704B in a first region of the body 702. The wheels 704A, 704B may be on opposite sides (widthwise) of the body 702. The tote tank 700 may further include a disposal inlet 706 in the same region of the tote tank 700 as the wheels 704A, 704B. The tote tank 700 may further include a flushing connection 707 in a second region of the body 702, opposite (lengthwise) the first region including the wheels 704A, 704B. The tote tank 700 may further include a tote handle 708 positioned on the second end of the tote tank 700. Notably, FIG. 7 depicts a tote tank 700 with the elongated mounting members 715A, 715B attached to the tote tank's body 702, but without the modular storage tank (e.g., modular storage tank 110 of FIG. 1) slid onto and secured to the elongated mounting members 715A, 715B. The elongated mounting members 715A, 715B may be affixed to the second region of the body 702 in the region near where the tote handle 708 ends attach to the body 702.

Figure 8:
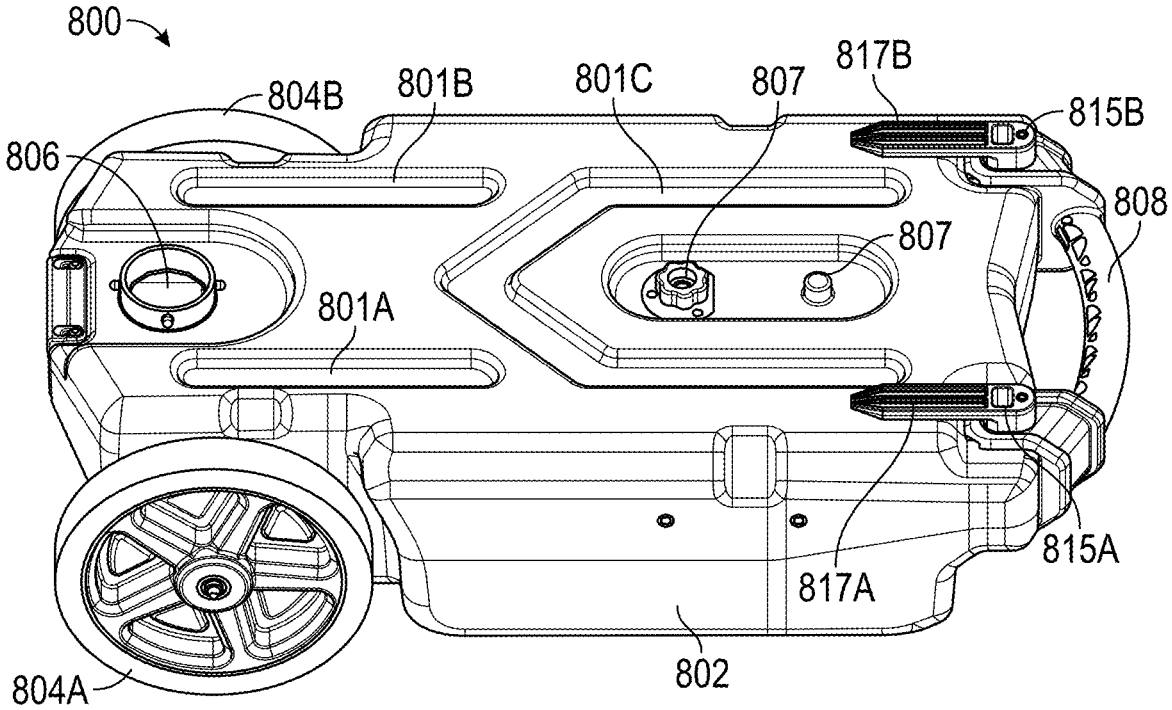
FIG. 8 is a diagram showing a side elevational illustration of an example blackwater tote tank, in accordance with various embodiments of the disclosed technology.

FIG. 8 is a diagram showing a side elevational illustration of an example blackwater tote tank 800, in accordance with various embodiments of the disclosed technology. The tote tank 800 may similarly include a body 802 with grooves 801A, 801B, 801C thereon. As discussed, the grooves 801A, 801B, 801C may be of varying designs and orientations, and may improve grip on the tank as well as improve stack-ability of multiple tanks. The tote tank 800 may further include one or more wheels 804A, 804B in a first region of the body 802. The wheels 804A, 804B may be on opposite sides (widthwise) of the body 802. The tote tank 800 may further include a disposal inlet 806 in the same region of the tote tank 800 as the wheels 804A, 804B. The tote tank 800 may further include a flushing connection 807 in a second region of the body 802, opposite (lengthwise) the first region including the wheels 804A, 804B. The tote tank 800 may further include a tote handle 808 positioned in the second region of the tote tank 800. Notably, FIG. 8 depicts a tote tank 800 with the elongated mounting members 815A, 815B attached to the tote tank's body 802. The elongated mounting members 815A, 815B may be affixed to the second region of the body 802 in the region near where the handle 808 ends attach to the body 802.

Figure 9:
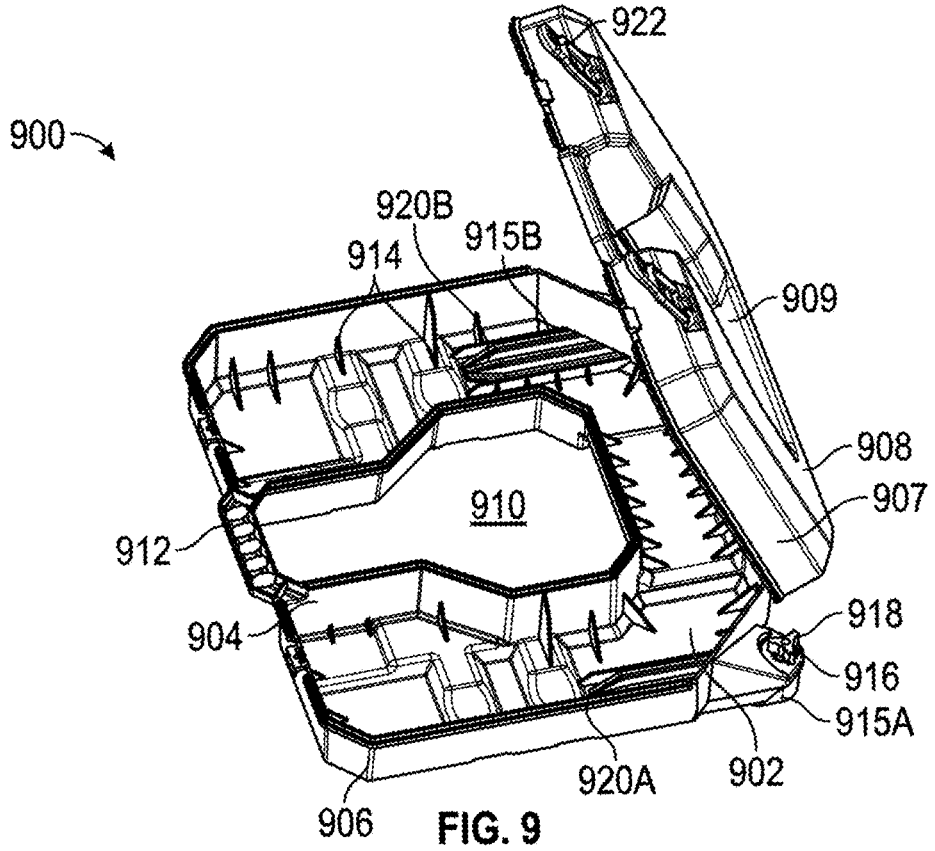
FIG. 9 is a diagram showing a raised perspective illustration of an example tote tank accessory kit case in an open position, in accordance with various embodiments of the disclosed technology.

FIG. 9 is a diagram showing a raised perspective illustration of an example tote tank accessory kit case or modular storage case 900 in an open position, in accordance with various embodiments of the disclosed technology. The modular storage case 900 may include a base 902 with a textured floor 914, which may increase grip and stability of contents placed in the case, bordered by a first outer edge and a first inner edge. The first inner edge may delineate an access gap 910. Some embodiments of the access gap 910 may include straight walls with multiple corners, e.g., 12 walls/sides or a dodecagon geometry, through the middle region of the floor, facilitating easy access to the flushing connection. The base 902 may be further structured internally by a lower interior wall 904 connected along the first inner edge, and externally by a lower exterior wall 906 along the first outer edge. The lower interior wall 904 and upper interior wall 909 may form a handle 912. The lower interior 904 and exterior walls 906 may extend perpendicularly from the textured floor. The exterior wall 906 may include a mounting channel 920A, 920B and a screw mount 916, the latter projecting perpendicularly away from the exterior wall 906 and featuring a screw hole for secure attachment. Some embodiments of the textured floor 914 may be without texture or smooth, while other embodiments may include floor designs or protrusions specific to the orientation or placement of accessories therein.

The mounting channels 920A, 920B may be configured to fit a corresponding elongated mounting member 915A, 915B, which may be slid into the mounting channel 920A, 920B from the exterior of the case 900. Once the elongated mounting members 915A, 915B are slid into the case 900, they may be secured with a screw 918. Further, the case 900 may be secured in the closed position with a rubber strap 922.

The modular storage case 900 may further include a lid. The lid may be affixed to the base 902 via a durable hinge (not shown). The lid may mirror the base's 902 design with a ceiling 908 that hosts a second outer edge and a second inner edge, the latter forming a matching dodecagonal access gap. When closed, the lid's upper interior wall 909 may align with the base's 902 lower interior wall 904. Additionally, an upper exterior wall 907 may extend from the ceiling's second outer edge and may align with the base's lower exterior wall 906, completing the enclosure.

Figure 10:
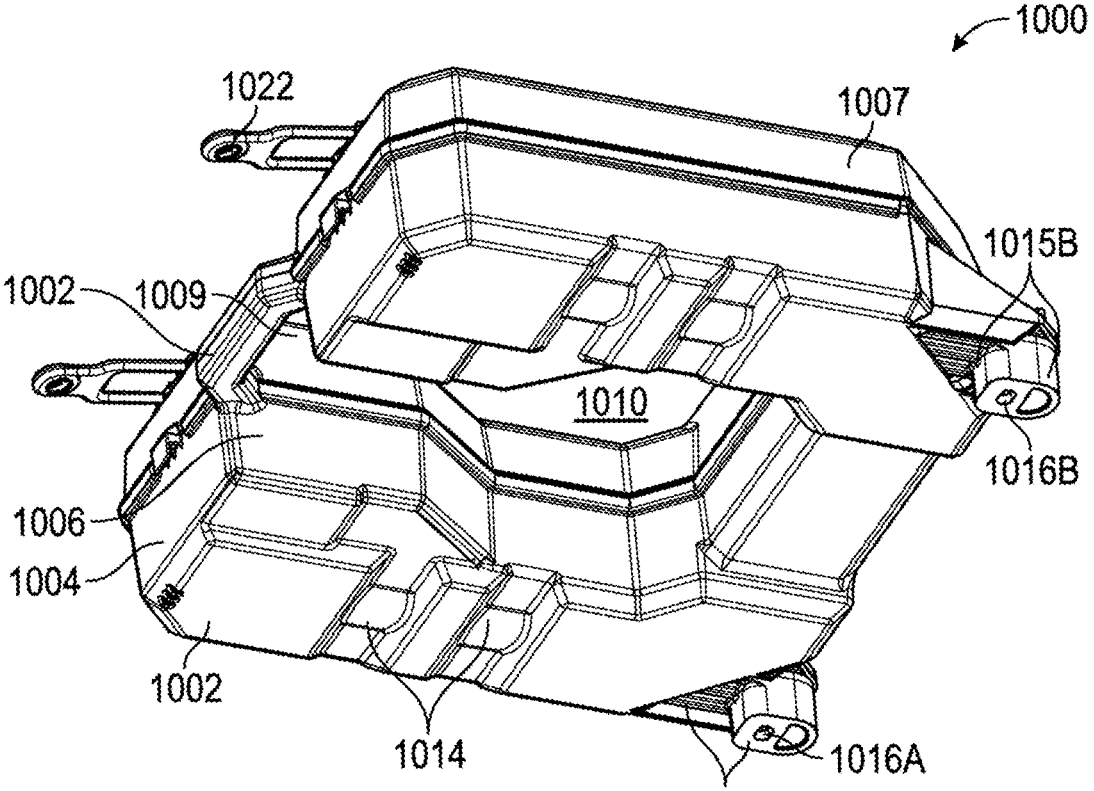
FIG. 10 is a diagram showing a lowered perspective illustration of an example tote tank accessory kit case in a closed position, in accordance with various embodiments of the disclosed technology.

FIG. 10 is a diagram showing a lowered perspective illustration of an example tote tank accessory kit case 1000 in a closed position, in accordance with various embodiments of the disclosed technology. The modular storage case 1000 may similarly include a base 1002 with a textured floor 1014, which may increase grip and stability of contents placed in the case, bordered by a first outer edge and a first inner edge. The first inner edge may delineate an access gap 1010. Some embodiments of the access gap 1010 may include straight walls with multiple corners, e.g., 12 walls/sides or a dodecagon geometry, through the middle region of the floor, facilitating easy access to the flushing connection. The base 1002 may be further structured internally by a lower interior wall 1006 connected along the first inner edge, and externally by a lower exterior wall 1004 along the first outer edge. The lower interior wall 1006 and upper interior wall 1009 may form a handle 1012. The lower interior 1006 and exterior walls 1004 may extend perpendicularly from the textured floor 1014. The exterior wall 1004 may include a mounting channel and a screw mount, the latter projecting perpendicularly away from the exterior wall 1004 and featuring a screw hole for secure attachment. Some embodiments of the textured floor 1014 may be without texture or smooth, while other embodiments may include floor designs or protrusions specific to the orientation or placement of accessories therein.

The mounting channels may be configured to fit a corresponding elongated mounting member 1015A, 1015B, which may be slid into the mounting channel from the exterior of the case 1000. Once the elongated mounting members 1015A, 1015B are slid into the case 1000, they may be secured with a screw, which may be secured in a tapped hole 1016A, 1016B. Further, the case 1000 may be secured in the closed position with a rubber strap 1022.

The modular storage case 1000 may further include a lid. The lid may be affixed to the base 1002 via a durable hinge (not shown). The lid may mirror the base's 1002 design with a ceiling (not shown) that hosts a second outer edge and a second inner edge, the latter forming a matching dodecagonal access gap. When closed, the lid's upper interior wall 1009 may align with the base's lower interior wall 1006. Additionally, an upper exterior wall 1007 may extend from the ceiling's second outer edge and may align with the base's lower exterior wall 1004, completing the enclosure.

Figure 11:
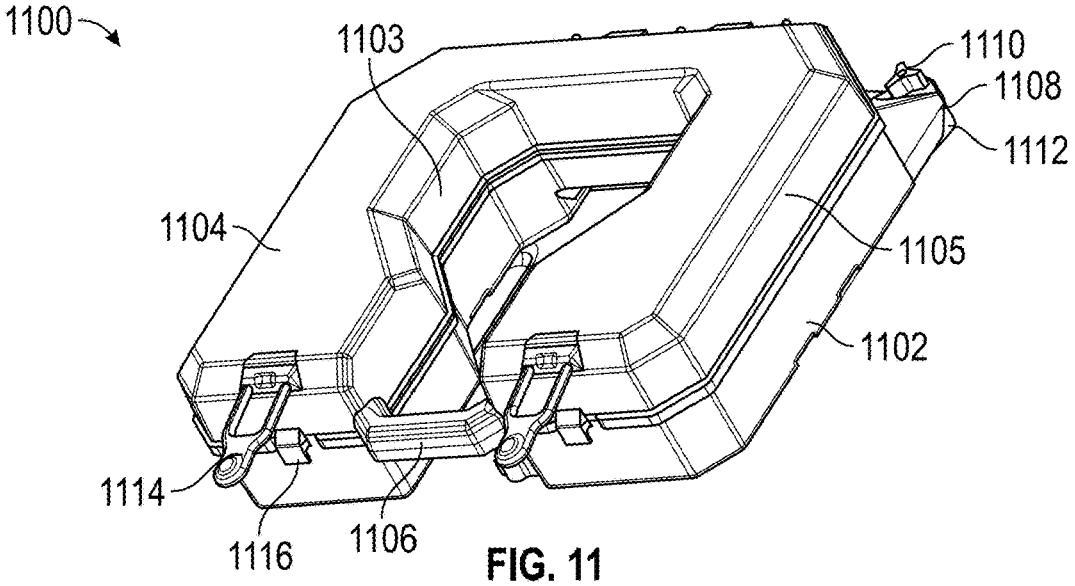
FIG. 11 is a diagram showing a raised perspective illustration of an example tote tank accessory kit case in a closed position, in accordance with various embodiments of the disclosed technology.

FIG. 11 is a diagram showing a raised perspective illustration of an example tote tank accessory kit case 1100 in a closed position, in accordance with various embodiments of the disclosed technology. The modular storage case 1100 may similarly include a base 1102 with a textured floor (not shown), bordered by a first outer edge and a first inner edge. The first inner edge may delineate an access gap. The base 1102 may be further structured internally by a lower interior wall connected along the first inner edge, and externally by a lower exterior wall along the first outer edge. The lower interior wall and upper interior wall 1103 may form a handle 1106. The lower interior and exterior walls may extend perpendicularly from the textured floor. The exterior wall may include a mounting channel and a screw mount 1108, the latter projecting perpendicularly away from the exterior wall and featuring a screw hole for secure attachment.

The mounting channels may be configured to fit a corresponding elongated mounting member 1112, which may be slid into the mounting channel from the exterior of the case 1100. Once the elongated mounting members 1112 are slid into the case 1100, they may be secured with a screw 1110. Further, the case 1000 may be secured in the closed position with a rubber strap 1114 pulled over a hook 1116 included on the lower exterior wall.

The modular storage case 1100 may further include a lid. The lid may be affixed to the base 1102 via a durable hinge (not shown). The lid may mirror the base's 1102 design with a ceiling 1104 that hosts a second outer edge and a second inner edge, the latter forming a matching dodecagonal access gap. When closed, the lid's upper interior wall 1103 may align with the base's lower interior wall. Additionally, an upper exterior wall 1105 may extend from the ceiling's 1104 second outer edge and may align with the base's lower exterior wall, completing the enclosure.

Figure 12:
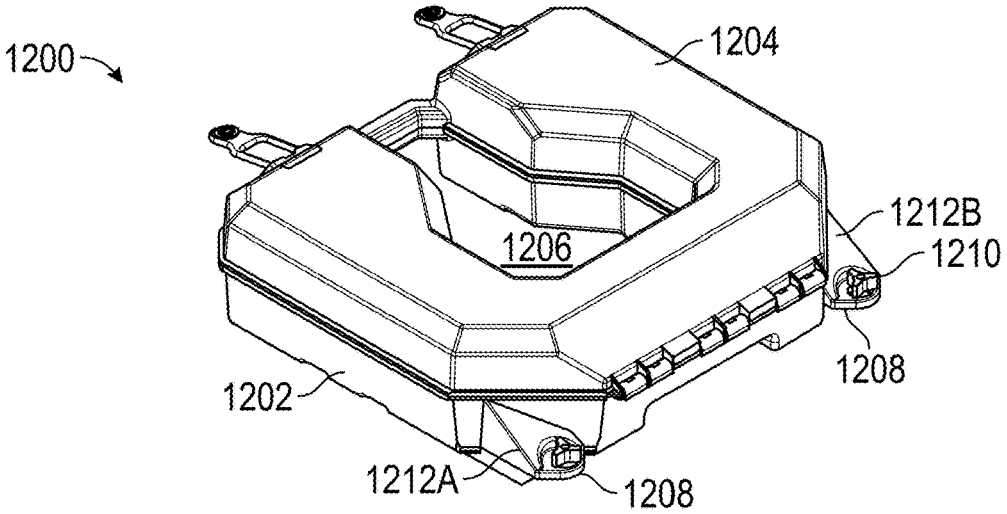
FIG. 12 is a diagram showing a second raised perspective illustration of an example tote tank accessory kit case in a closed position, in accordance with various embodiments of the disclosed technology.

FIG. 12 is a diagram showing a second raised perspective illustration of an example tote tank accessory kit case 1200 in a closed position, in accordance with various embodiments of the disclosed technology. The modular storage case 1200 may similarly include a base 1202 and a lid 1204 with an open central region forming an access gap 1206. The base 1202 may include mounting channels 1208 covered by a screw mount 1212A, 1212B with a screw 1210 disposed therethrough. The mounting channels may be configured to fit a corresponding elongated mounting member, which is notably removed from FIG. 12.

Figure 13:
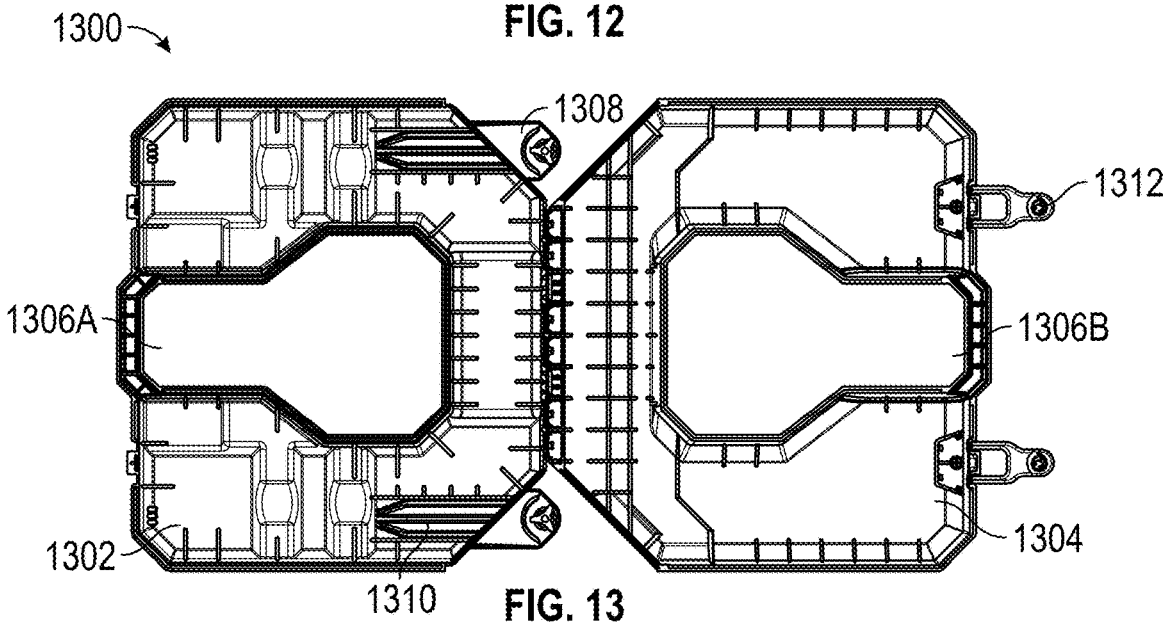
FIG. 13 is a diagram showing a top plan illustration of an example tote tank accessory kit case in an open position, in accordance with various embodiments of the disclosed technology.

FIG. 13 is a diagram showing a top plan illustration of an example tote tank accessory kit case 1300 in an open position, in accordance with various embodiments of the disclosed technology. The modular storage case 1300 may include a base 1302 and a lid 1304. The base 1302 may include an opening through the central region forming an access gap 1306A. The lid 1304 may include a corresponding opening through the central region forming a matching access gap 1306B. The base 1302 may also include a mounting channel covered by a screw mount 1308 that is configured to secure an elongated mounting member 1310 therein. The lid 1304 may also include a rubber strap 1312 to secure the lid 1304 to the base 1302 during transport.

Figure 14:
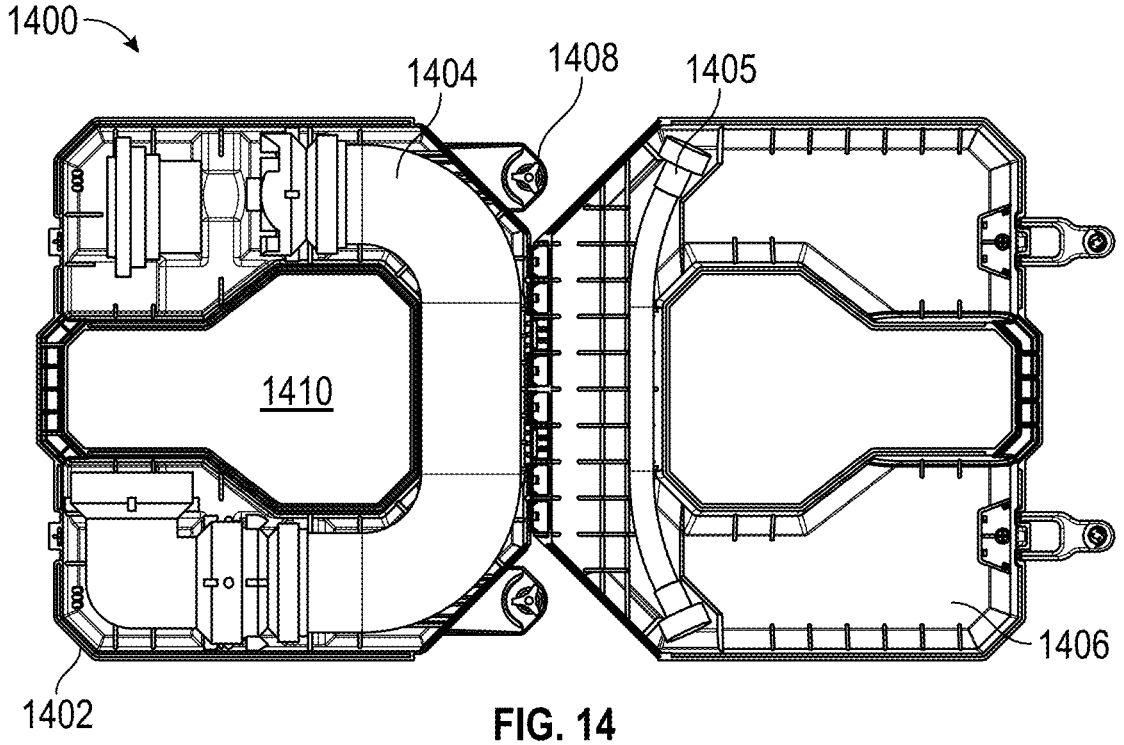
FIG. 14 is a diagram showing a top plan illustration of an example tote tank accessory kit case in an open position with a blackwater hose disposed therein, in accordance with various embodiments of the disclosed technology.

FIG. 14 is a diagram showing a top plan illustration of an example tote tank accessory kit case 1400 in an open position with a blackwater hose 1404 disposed therein, in accordance with various embodiments of the disclosed technology. The case 1400 may include a base 1402 with a blackwater hose 1404 disposed therein. The base 1402 may connect to a lid 1406, which may be configured to close and secure the blackwater hose 1404 within the case 1400. Some embodiments may include additional accessories 1405 that can be secured in the lid 1406 of the case 1400. These additional accessories 1405 may include hoses, connectors, cleaners, and other blackwater disposal accessories one may use. From the base, a screw mount 1408 may extend. The base 1402 may further include an access gap 1410 or region to allow users to reach a blackwater tank (not shown) without interacting with the case 1400. The flooring of the base 1402 may be textured such that when a hose 1404 is placed in the case, the elongated mounting member is still able to be slid and out of the case. Some embodiments may include space between the hose and the elongated mounting member, the space created by ridges or bridges in the textured flooring.

Figure 15:
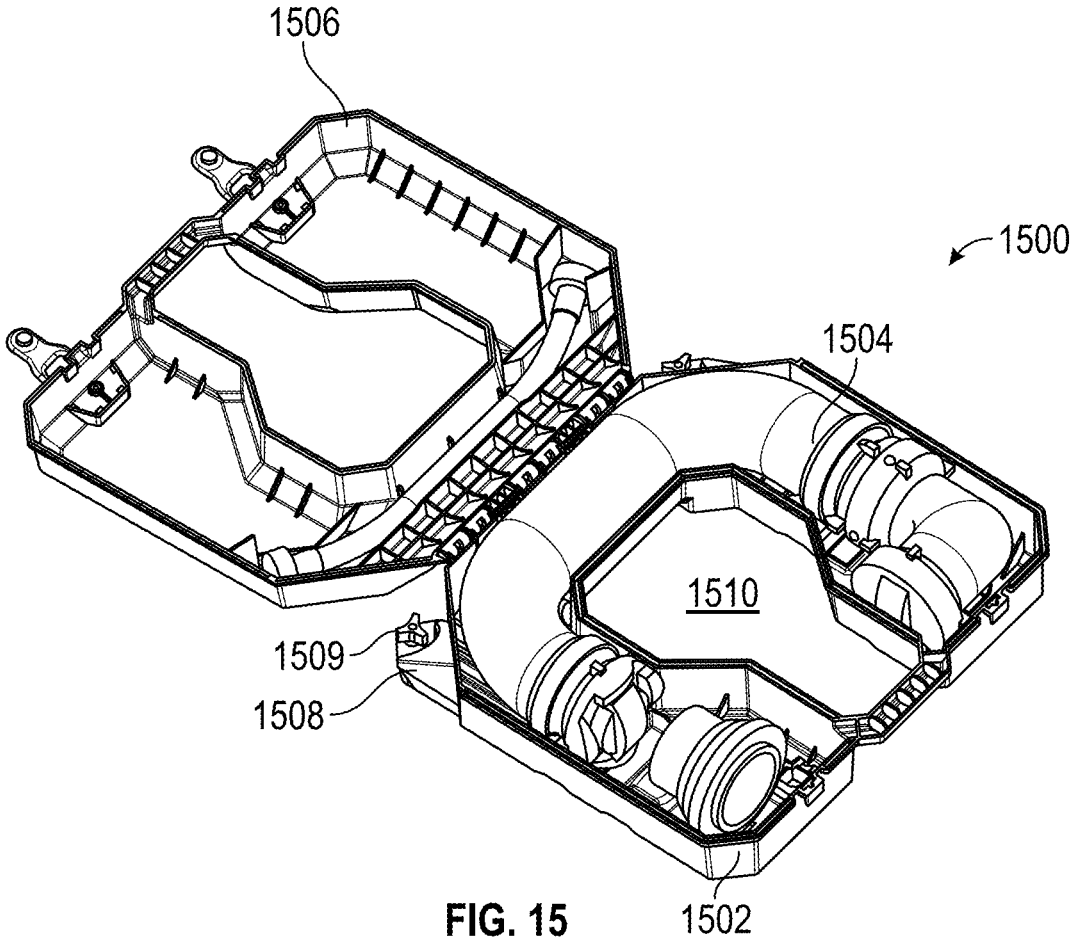
FIG. 15 is a diagram showing a perspective illustration of an example tote tank accessory kit case in an open position with a blackwater hose disposed therein, in accordance with various embodiments of the disclosed technology.

FIG. 15 is a diagram showing a perspective illustration of an example blackwater tote tank accessory kit case 1500 in an open position with a blackwater hose 1504 disposed therein, in accordance with various embodiments of the disclosed technology. The case 1500 may include a base 1502 with a blackwater hose 1504 disposed therein. The base 1502 may connect to a lid 1506, which may be configured to close and secure the blackwater hose 1504 within the case 1500. From the base a screw mount 1508 may extend. The screw mount 1508 may include a screw 1509, e.g., a thumb screw that passes therethrough. The base 1502 may further include an access gap 1510 or region to allow users to reach a blackwater tank (not shown) without interacting with the case 1500.

FIG. 16 is a diagram showing a top plan view of an example elongated mounting member 1600, in accordance with various embodiments of the disclosed technology. The elongated mounting member 1600 may include a frame 1602 with a first end (shown in FIG. 16 by the combination of 1604 and 1606) and a second end 1608. The first end may include various holes, for example, the first end may include a depressed hole 1604 and a tapped hole 1606. The depressed hole 1604 may be used in some embodiments for a screw or other fastener to be placed into the depression and screwed into the handle or surrounding area of the blackwater tank (described above). The tapped hole 1606 may be used in some embodiments where a screw or bayonet is placed through the screw cover of the modular case to secure the modular case to the elongated mounting member 1600. Accordingly, the tapped hole 1606 may be placed to align with the screw hole of the case. In further embodiments, the elongated mounting member 1600 may not include one or both of these holes, for example, some embodiments may not have the depressed hole 1604 and the screw may be placed through the screw cover into the tapped hole 1606 and through the bottom of the tapped hole 1606 to attach to the blackwater tank.

The first end may connect to the second end 1608 by a frame 1602. The frame may have a distance, which may range from 0.01 inches to 25 inches, and a width of 0.01 inches to 10 inches. Other lengths and widths may also exist. The frame may include valleys (as discussed in relation to FIG. 18) and may be constructed from a molded plastic or similar suitable material. The second end 1608 may be on the opposing end (lengthwise) of the frame from the first end. The second end 1608 may be of various geometries. As depicted in FIG. 16, the second end 1608 may narrow further away from the frame. The second end 1608 may narrow both laterally and vertically, forming an "arrow" shape. In other embodiments, the second end 1608 may remain a constant length or width as it extends away from the frame 1602.

FIG. 17 is a diagram showing a side plan view of an example elongated mounting member 1700, in accordance with various embodiments of the disclosed technology. The side plan view of the elongated mounting member 1700 similarly depicts a frame 1702, which may have a height (in addition to its length and width described above) and may further include a first end 1704 and a second end 1706. Notably, FIG. 17 depicts the underside geometry of the first end 1704, which may extend beyond a bottom side of the frame, as to house the depressed hole and tapped hole of FIG. 16. By having the first end 1704 extend beyond the bottom side of the frame, the frame may be held a raised distance away from the blackwater tank the elongated mounting member is secured to. By maintaining this distance between the frame and the blackwater tank, the elongated mounting member may allow for the modular case to be slid onto the elongated mounting member 1700 with portions of the mounting channel around the top, side, and bottom of the frame 1702. Further, FIG. 17 depicts an exemplary height-based geometry of the second end 1706, which may also narrow as it extends away from the frame 1702.

FIG. 18 is a diagram showing a perspective view of an example elongated mounting member 1800, in accordance with various embodiments of the disclosed technology. The elongated mounting member 1800 may similarly include a frame 1802 with a first end, including a depressed hole 1804 and a tapped hole 1806, further including a first end housing 1808, and a second end 1810, which may include narrowing edges 1812 whose width decreases as it extends away from the frame 1802. Notably, the frame 1802 may include valleys 1814, which may help reduce the weight of the elongated mounting member 1800 and may further assist in guiding the elongated mounting member 1800 into the mounting channel of the modular case.

Figure 19:
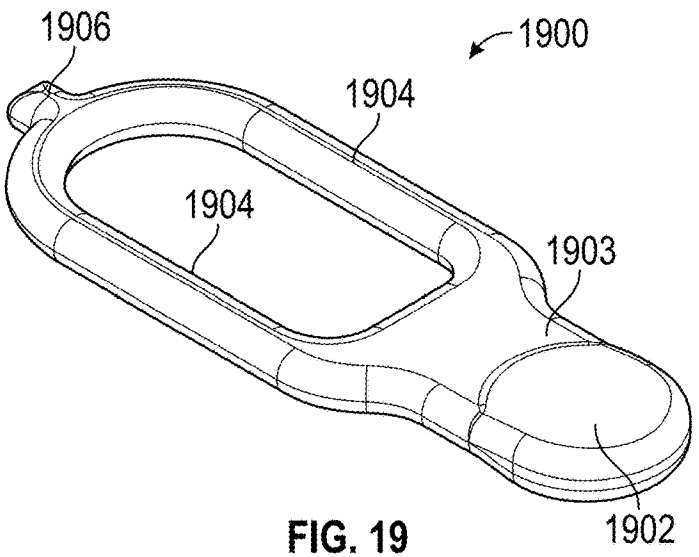
FIG. 19 is a diagram showing a perspective view of an example rubber strap, in accordance with various embodiments of the disclosed technology.

FIG. 19 is a diagram showing a perspective view of an example rubber strap 1900, in accordance with various embodiments of the disclosed technology. The rubber strap 1900 may include a first attachment end 1902 and a second attachment end 1906. The first attachment end 1902 may include various types of attachment mechanisms including snaps, screws, rivets, and other fasteners. The first attachment end 1902 may connect to body straps 1904 via a connection bridge 1903. The body straps 1904 and connection bridge 1903 may be constructed of rubber or plastic and may be flexible to allow the second end 1906 to remain affixed to the lid of the modular case while the first attachment end 1902 is detached from the base of the modular case. In various embodiments, the body straps 1904 may be separated into two straps, as depicted. This may be done to increase flexibility and to reduce weight of the rubber strap 1900.

Generally, the rubber strap 1900 may be attached to the upper exterior wall of the lid and may be configured to be pulled over a hook included on the lower exterior wall of the base to secure the modular case in a closed position. The rubber strap 1900 may also be combined with a strap cover, which may be configured to snap onto the upper exterior wall of the lid to hold the rubber strap in place. The strap cover (not shown) may further include a second screw installed through an underside of the lid and into the strap cover to secure the strap cover in place.

It should be understood that the various features, aspects and functionality described in one or more of the individual embodiments are not limited in their applicability to the particular embodiment with which they are described. Instead, they can be applied, alone or in various combinations, to one or more other embodiments, whether or not such embodiments are described and whether or not such features are presented as being a part of a described embodiment. Thus, the breadth and scope of the present application should not be limited by any of the above-described exemplary embodiments.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like; and adjectives such as "conventional," "traditional," "normal," "standard," "known." Terms of similar meaning should not be construed as limiting the item described to a given time period or to an item available as of a given time. Instead, they should be read to encompass conventional, traditional, normal, or standard technologies that may be available or known now or at any time in the future. Where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "component" does not imply that the aspects or functionality described or claimed as part of the component are all configured in a common package. Indeed, any or all of the various aspects of a component, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A modular case for transportation and storage of blackwater accessories, the modular case configured to be disposed on a blackwater tank, comprising: a repeatably closeable case comprising a base and a lid; a mounting channel disposed within the base and covered by a screw cover; and an elongated mounting member disposed on the blackwater tank and configured to be attached to the modular case via a screw on a first end and received via a frame in the mounting channel on a second end; wherein the elongated mounting member extends perpendicularly away from the screw a distance corresponding to an internal mounting channel distance.

2. The modular case of claim 1, wherein the base, the lid, and the elongated mounting member are constructed from molded plastic.

3. The modular case of claim 1, wherein the base and the lid each include an opening through their respective middle regions such that when the case is disposed on the blackwater tank, a user can access the blackwater tank through a middle region of the modular case without physically touching the modular case.

4. The modular case of claim 1, wherein the blackwater tank comprises a screw on a handle of the blackwater tank to secure the elongated mounting member to a top portion of the handle of the blackwater tank and further to allow the base to slide onto the elongated mounting member and be secured with a screw.

5. The modular case of claim 1, further comprising:

a rubber strap, attached to the lid, and configured to be pulled over a hook included on the base to secure the modular case in a closed position; and a strap cover, configured to snap onto the lid to hold the rubber strap in place, further comprising a second screw installed through an underside of the lid into the strap cover.

6. The modular case of claim 1, wherein the distance the elongated mounting member extends perpendicularly away from the screw is equivalent to the internal mounting channel distance.

7. A modular storage case releasably attachable to a portable blackwater tank, comprising:

a base, comprising:

a textured floor comprising a first outer edge and a first inner edge, wherein the first inner edge defines an access gap through a middle region of the textured floor;

a lower interior wall connected to the textured floor along the first inner edge; and a lower exterior wall connected to the textured floor along the first outer edge;

wherein the lower exterior wall further comprises a mounting channel and a screw mount, the screw mount extending perpendicularly away from the lower exterior wall and comprising a screw hole;

a lid, comprising:

a ceiling comprising a second outer edge and a second inner edge, wherein the second inner edge defines a matching access gap through a middle region of the ceiling;

an upper interior wall connected to the ceiling along the second inner edge adjacent to an upper perimeter of the matching access gap, and wherein the upper interior wall aligns with the lower interior wall, when the modular storage case is in a closed position; and an upper exterior wall connected to the ceiling along the second outer edge;

an elongated mounting member, comprising:

a frame with a first end and second end;

the first end comprising a tapped hole, wherein the tapped hole is configured to align with the screw hole and a corresponding hole in the portable blackwater tank; and the second end comprising an angled point, wherein the mounting channel is configured to receive the elongated mounting member.

8. The modular storage case of claim 7, wherein the base, the lid, and the elongated mounting member are constructed from molded plastic.

9. The modular storage case of claim 7, further comprising a handle, the handle comprising a lower half connected to the lower interior wall and an upper half connected to the upper interior wall.

10. The modular storage case of claim 7, further comprising:

a rubber strap, attached to the upper exterior wall of the lid, and configured to be pulled over a hook included on the lower exterior wall of the base to secure the modular storage case in a closed position; and a strap cover, configured to snap onto the upper exterior wall of the lid to hold the rubber strap in place, further comprising a second screw installed through an underside of the lid and into the strap cover.

11. The modular storage case of claim 7, wherein the modular storage case is configured to be attached to the portable blackwater tank when in the closed position, such that when the modular storage case is in the closed position, the modular storage case is slid on to the elongated mounting member via the mounting channel and secured with a screw.

12. The modular storage case of claim 7, further comprising a second elongated mounting member disposed on the portable blackwater tank and a second mounting channel disposed on the base.

13. The modular storage case of claim 7, wherein the access gap is a dodecagon.

14. A storage case for sewer hose accessories, comprising:

a base, a lid, two elongated mounting members, and two mounting channels;

wherein the base comprises a textured floor, an interior wall and exterior wall each adjacent to the textured floor, and two mounting channels;

the lid comprises a ceiling, and a corresponding interior wall and corresponding exterior wall each adjacent to the ceiling; and the two elongated mounting members each comprise a tapped hole and a frame configured to be received by the two mounting channels.

15. The storage case of claim 14, further comprising an access gap spaced through a center region of the textured floor and ceiling.

16. The storage case of claim 14, further comprising two screw mounts, each screw mount extending perpendicularly away from the exterior wall of the base, and each comprising a screw hole.

17. The storage case of claim 16, wherein the tapped hole is configured to align with the screw hole and a corresponding hole in a tank.

18. The storage case of claim 14, further comprising a handle, the handle comprising a lower half connected to the interior wall of the base and an upper half connected to the interior wall of the lid.

19. The storage case of claim 14, further comprising:

a rubber strap, attached to the corresponding exterior wall of the lid, and configured to be pulled over a hook included on the exterior wall of the base to secure the storage case in a closed position; and a strap cover, configured to snap onto the corresponding exterior wall of the lid to hold the rubber strap in place, further comprising a second screw installed through an underside of the lid and into the strap cover.

20. The storage case of claim 15, wherein the access gap is a dodecagon.

* * * * *